United States Patent [19]

Loucks

[11] Patent Number: 4,609,225

[45] Date of Patent: Sep. 2, 1986

[54] FOLDING CHAIR WITH MEMBRANE SHELL

[76] Inventor: Harry D. Loucks, 2901 Fair Park Blvd., Little Rock, Ark. 72204

[21] Appl. No.: 692,192

[22] Filed: Jan. 17, 1985

[51] Int. Cl.[4] ..... A47C 7/00

[52] U.S. Cl. ..... 297/440; 297/32; 297/457; 297/DIG. 2; 297/239

[58] Field of Search ..... 297/440, 457, 452, DIG. 2, 297/53, 51, 37, 460, 32, 33, 131

[56] References Cited

U.S. PATENT DOCUMENTS

| | | | |
|---|---|---|---|
| 1,162,104 | 11/1915 | Robinson | 297/37 |
| 2,788,846 | 4/1957 | Hauser | 297/457 |
| 3,061,374 | 10/1962 | Grosfillex | 297/457 |
| 3,319,999 | 5/1967 | Lieberman et al. | 297/457 |
| 3,797,887 | 3/1974 | Barecki et al. | 297/DIG. 2 |
| 3,941,418 | 3/1976 | Bernard | 297/DIG. 2 |
| 4,368,917 | 1/1983 | Urai | 297/DIG. 2 |
| 4,418,958 | 12/1983 | Watkin | 297/460 |

FOREIGN PATENT DOCUMENTS

| | | | |
|---|---|---|---|
| 1358413 | 3/1964 | France | 297/440 |

*Primary Examiner*—Francis K. Zugel
*Attorney, Agent, or Firm*—M. Lee Murrah

[57] ABSTRACT

A chair is disclosed in which a support member is provided by a membrane shell having at least one structural support region of relatively low resilience and at least one flexing region of relatively greater resilience to provide for the structural integrity of the membrane shell yet to permit the support surface to deform under loading for the comfort of the person seated thereon. Further, a folding chair is disclosed which provides a plurality of legs hingedly connected to the support member and disposed to swing between a first position which folds flatly against the underside of the support member and a second position which distends the legs for holding the chair in a convenient position for use.

9 Claims, 12 Drawing Figures

FOLDING CHAIR WITH MEMBRANE SHELL

BACKGROUND OF THE INVENTION

This invention relates to a chair, more particularly, to a folding stackable chair and for a support member providing a seating surface which is formed by a membrane shell having areas of varying resilience to provide structural integrity and to allow for conforming to dimensions critical for the comfort of an individual seated upon the chair.

Many meeting facilities and other applications depend upon the availability of temporary seating for large groups of people. Metal folding chairs are common in the prior art for multipurpose classrooms, conference rooms and for domestic use. The folding chairs of the prior art fold straight front and rear legs together on each side and fold the seat against the back of the chair to collapse the chair for transport or storage. However, such chairs are heavy, uncomfortable and stack poorly for storage.

Improved temporary and storable seating should be light for handling, compact for storage and easily setup for use. In addition, the support surfaces of the chairs should be simple, inexpensive, strong, wear-resistant and comfortable.

SUMMARY OF THE INVENTION

It is therefore an object of the present invention to provide a simple, inexpensive membrane shell which provides both strength and comfort in establishing a support member for a chair.

It is a further object of the present invention to provide a base for a chair which folds compactly against the underside of the support member for chair storage and readily extends presenting the chair ready for use.

Finally, it is an object of the present invention to promote ease of storage by configuring a base and support member combination which facilitates stacking a plurality of chairs in a compact, nested orientation.

Toward the fulfillment of these and other objects according to the chair of the present invention, a support member comprising a membrane shell is provided in which the membrane shell has regions of varying resilience. These regions include at least one structural support region of relatively low resilience or elasticity which is substantially rigid and at least one flexing region of relatively greater resilience. The structural support region and the flexing regions are combined to provide structural support for the structural integrity of the membrane shell yet provide flexing regions of greater resilience to permit the support surface of the support member to deform under loading for the comfort of the person seated in the chair.

This aspect of the invention provides comfortable seating in a variety of forms including stools, benches, chairs, chaise longues, and the like.

In another aspect of the invention, the base provides folding features for membrane shell or other support surfaces having at least two, nonparallel, support surfaces. Typically, the support surfaces are the seat and back of a chair. A folding chair of the present invention provides a plurality of legs hingedly connected to the support member and disposed to swing between a first position which folds flatly against the underside of the support member beneath both the first and second support surfaces and a second position which distends the legs for holding the chair in a convenient position for use.

BRIEF DESCRIPTION OF THE DRAWINGS

The above brief description as well as further objects, features and advantages of the present invention will be more fully appreciated by reference to the following detailed description of the presently preferred, but nonetheless illustrative, embodiment of the present invention with reference to the accompanying drawings in which.

DETAILED DESCRIPTION OF THE PREFERRED EMBODIMENTS

Figure 1:
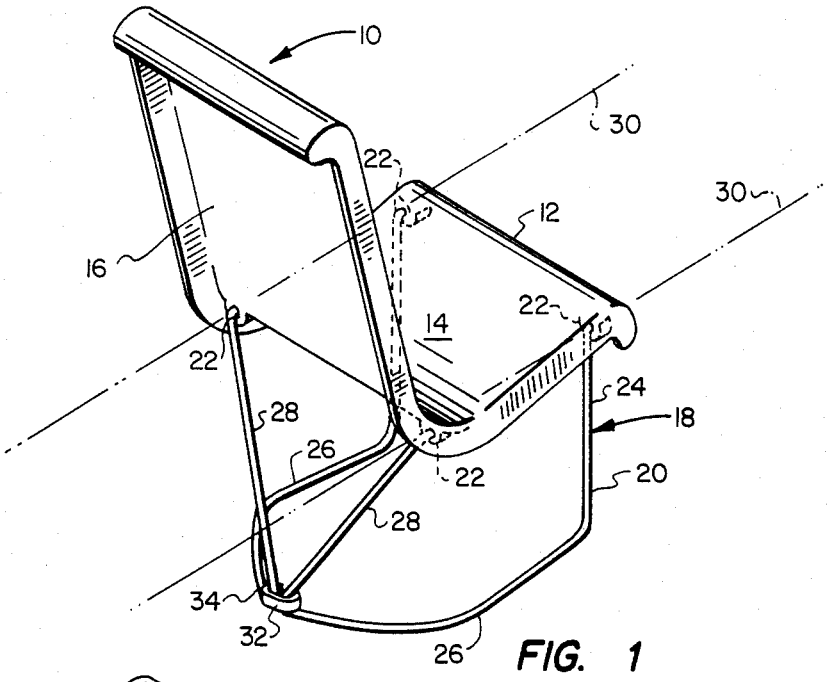
FIG. 1 is a perspective view of a chair constructed in accordance with the present invention.

Referring to FIG. 1 of the drawings, the reference 10 refers generally to a chair constructed in accordance with the present invention. Support member 12 presents seating or support surfaces 14 and underside 16. Support member 12 is mounted upon a base 18 which, in one aspect of the invention, has legs 20 pivotally mounted to support member 12 at hinges 22. In the preferred embodiment, legs 20 have a forward upright 24 which is pivotally mounted within one hinge 22 on one end and joins runner 26 on its other end. Runner 26 is connected on its other end to rearward upright 28. The other end of rearward upright 28 pivotally mounts within another hinge 22. In FIG. 1, the hinges 22 within which forward uprights 24 and rearward upright 28 of each of legs 20, pivotally mount are coaxial with respect to one another on each side.

Locking means 32 is provided for securing legs 20 in the extended position illustrated in FIG. 1 which presents support surfaces 14 ready for use. In the preferred embodiment, locking means 32 is provided by latch 34 which connects opposing legs 20 to secure base 18.

Figure 2:
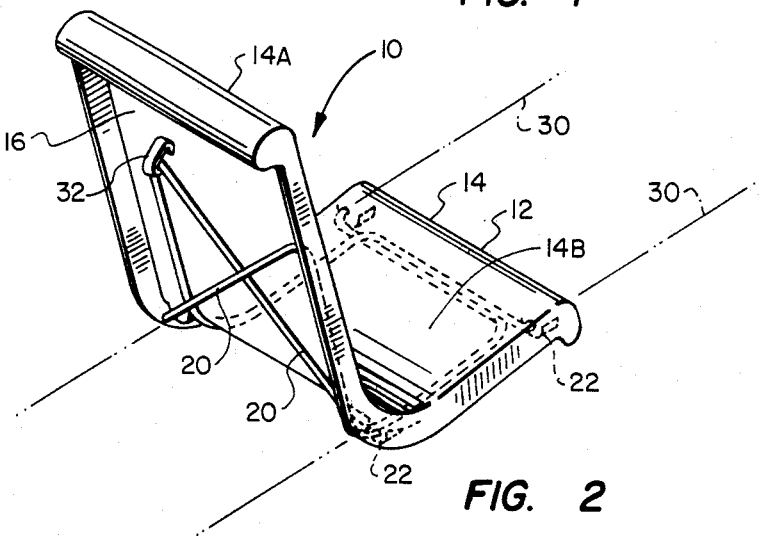
FIG. 2 is a perspective view of a chair constructed in accordance with the present invention in which the legs are folded inward.

Referring to FIG. 2, chair 10 is illustrated with legs 20 folded flatly against underside 16 of support member 12 to follow the contours of underside 16. The chair in FIG. 1 is collapsed for storage as illustrated in FIG. 2 by releasing locking means 32 and pivoting each of legs 20 to bring them adjacent underside 16 of support member 12. Each of legs 20 is configured to follow the contours of underside 16 for folding flatly there-against nonparallel support surfaces 14 such as provided by the back 14A and the seat 14B of the chair.

Figure 6:
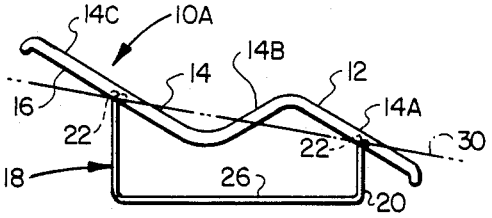
FIG. 6 is a side elevational view of a chaise longue embodiment of a chair constructed in accordance with the present invention.

Other configurations of support member 12 will provide different contours of underside 16 against which legs 20 will fold for storage of the chair. For example, FIG. 6 illustrates an alternate embodiment in a chaise longue 10A which presents three seating or support surfaces on different planes, here 14A, 14B and 14C, respectively. This configuration will provide contours in runner 26 which will allow legs 20 to fold flatly against underside 16 of support member 12 when the legs are folded about axis of rotation 30 of the hinges 22 connecting base 18 to support member 12.

Figure 5:
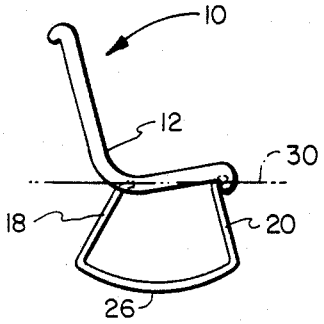
FIG. 5 is a side elevational view of a rocking chair embodiment of the present invention.

FIG. 5 discloses a rocking chair embodiment of chair 10. Again, legs 20 of base 18 fold about axis of rotation 30 to fold flatly against the underside of support member 12. However, here runners 26 of legs 20 are configured to form an arc about which chair 10 will rock.

Figure 3:
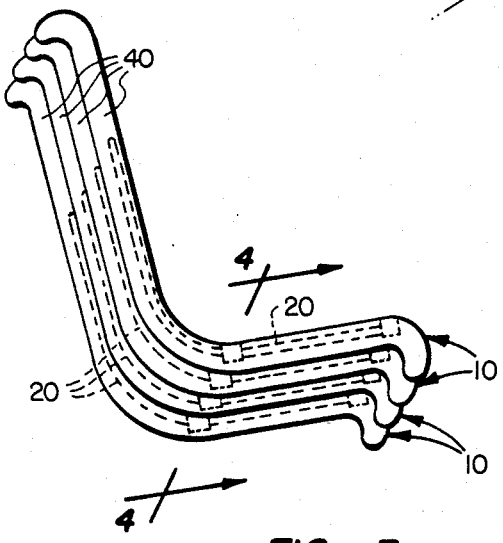
FIG. 3 is a side elevational view of a plurality of chairs constructed in accordance with the present invention which are stacked for storage.
Figure 4:
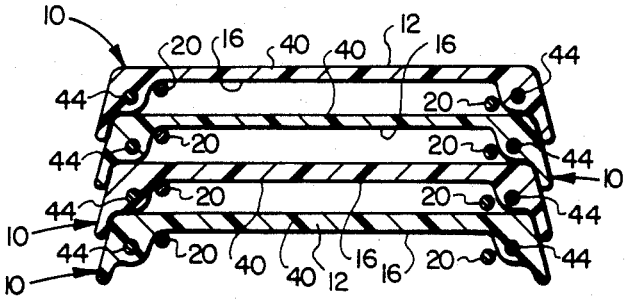
FIG. 4 is a cross sectional view taken along line 4—4 of FIG. 3 of a plurality of stacked chairs constructed in accordance with the present invention.

FIG. 3 illustrates a plurality of chairs 10 stacked one on top of each other with legs 20 in the folded position. Important to this feature of the present is the use of a membrane shell 40 which is configured to stack in a nested relation. FIG. 4 is a cross section through chairs 10 of FIG. 3 and illustrates the relation of shoulders 42 which grip on either side of the next adjacent chair below. Another important aspect of this stackable feature is that legs 20 fold substantially flat against underside 16 to a position which is fully withdrawn within shoulders 42 to prevent interference when the chairs are stacked. Dimensional stability is aided by metal rods 44 in membrane shell 40.

Figure 12:
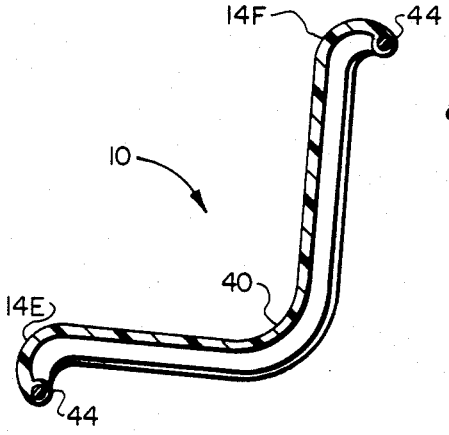
FIG. 12 is a cross sectional view taken along line 12—12 of FIG. 7, of a chair constructed in accordance with the present invention.

FIG. 4 illustrates the preferred position of metal rods 44 adjacent underside 16 of support member 12 along the sides of membrane shell 40. However, metal rods 44 should be offset from the membrane shell 40 at the lower and upper edges thereof so as to not interfere with the resilience of the membrane shell at these bands of contact. FIG. 12 illustrates one embodiment wherein metal rods 44 are offset from the lower and upper surfaces 14E and 14F of membrane shell 40. This embodiment incorporating metal rods 44 allows manufacture with a range of plastics and vinyls in which the metal rods are placed inside a unitary membrane shell, by molding or the like.

Figure 7:
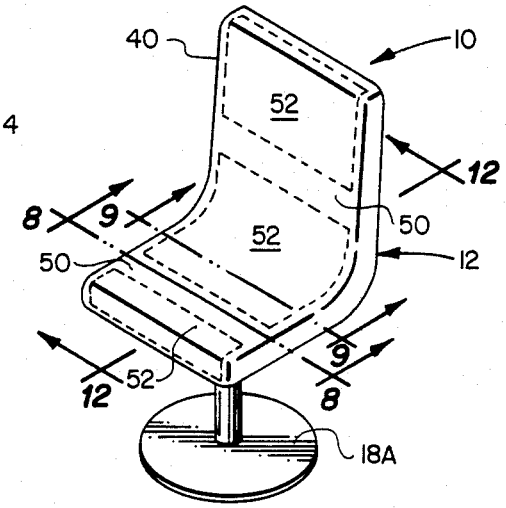
FIG. 7 is a perspective view of a chair constructed in accordance with the present invention.

Another aspect with the present invention dealing with features of membrane shell 40 is illustrated in FIGS. 7–11. FIG. 7 illustrates membrane shell 40 providing support member 12 upon a conventional base 18A. The membrane shell of the embodiment of FIG. 7 is provided with structural support regions 50 of relatively low resilience interspersed with flexing regions 52 of relatively high resilience. Resilience is used here to define the relative elasticity under normal loading and corresponds to the degree of elastic deformation or other yielding provided by the membrane shell.

Figure 8:
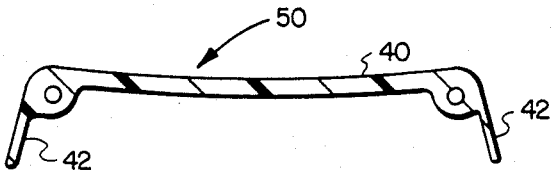
FIG. 8 is a cross sectional view taken along line 8—8 in FIG. 7 of the chair constructed in accordance with the present invention.
Figure 9:
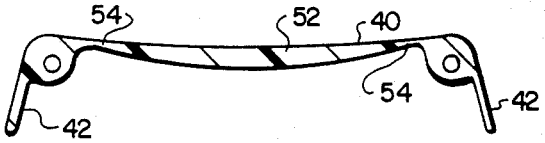
FIG. 9 is a cross sectional view taken along line 9—9 of FIG. 7 of the chair constructed in accordance with the present invention.

FIG. 8 is a cross section of membrane shell 40 of FIG. 7 taken at line 8—8 which intersects one of the structural support regions 50. This section illustrates a relatively thick and uniform cross section for membrane shell 40. This configuration maximizes strength and minimizes deflection in this region of relatively low resilience. By contrast, FIG. 9 is a cross section of membrane shell 40 of FIG. 7 taken at line 9—9 sectioned through one of flexing regions 52. In this particular embodiment, resilience and deflection is increased latitudinally across the chair allowed by thinning edges 54 of shell membrane 40 to facilitate the elastic deformation of membrane shell 40 at flexing regions 52 for promoting comfort under load. Latitudinally disposed flexing regions provide longitudinal and latitudinal resilience.

Figure 10:
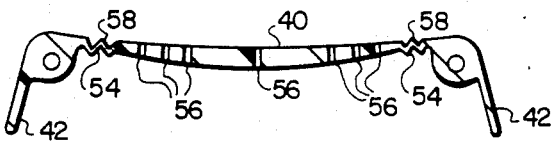
FIG. 10 is a cross sectional view of an alternate embodiment of a chair constructed in accordance with the present invention.

FIG. 10 illustrates another alternative embodiment of membrane shell 40 in which areas of varying resilience are provided by varying the density, spacing, position, size and configuration of perforations 56 through membrane shell 40. Regions designed for deflection are then provided with a greater density of the perforations as illustrates here or some other combination of position, size and configuration to provide areas of increased relative effective density for greater elasticity.

FIG. 10 also illustrates another embodiment for providing areas of increased deflection by the formation of accordion panels 58 at edges 54 of flexing regions 52 (see FIG. 7) of membrane shell 40 at those points where deflection is desired. Accordion panels 58 provide significant lateral expansion upon loading.

Figure 11:
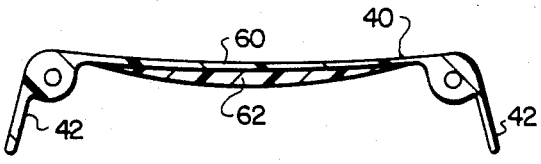
FIG. 11 is a cross sectional view of an alternate embodiment of a chair constructed in accordance with the present invention.

Finally, another embodiment of membrane shell 40 is illustrated in FIG. 11 wherein the unitary membrane shell is formed from the lamination of two or more layers, here layers 60 and 62. The lamination technique provides for the adjustment of resilient characteristics by the presence or absence of various layers in that region.

Other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A chair, comprising:

a support member having at least first and second support surfaces an aspect of each which is angled with respect to the other;

a first integral leg member comprising a forward upright, a rearward upright, and a runner connected therebetween, said runner being bent to conform to the angle between the aspects of the first and second support surfaces; and a second integral leg member comprising a forward upright, a rearward upright, and a runner connected therebetween, said runner being bent to conform to the angle between the aspects of the first and second support surfaces;

said first and second leg members being foldable flat against said first and second support surface for storage;

2. A chair as described in claim 1 further including means for locking said first and second leg members in an extended position for use.

3. A chair as described in claim 2 wherein said runners in said first and second leg members are of sufficient length for their rearward ends to be adjacent each other when said leg members are in the extended position.

4. A chair as described in claim 3 wherein said rearward uprights in said first and second leg members are angled and are connected to the rearward end of each of said runners, respectively.

5. A chair as described in claim 4 wherein said locking means is positioned at the conjunction of said rearward uprights and said runners of said first and second leg members.

6. A chair as described in claim 5 wherein said locking means comprises a latch.

7. A chair as described in claim 1 wherein said the runners on said first and second leg members are positioned with their bends mutually directed.

8. A chair as described in claim 7 wherein the chair is a rocking chair and each leg member ends in an arc with respect to a vertical plane when each said leg member is in the extended position.

9. A chair as described in claim 7 wherein the chair is a chaise lounge having a third support surface which is not coplanar with the first and second mutually angled support surfaces.

* * * * *